US008510870B2

(12) United States Patent
Rogers et al.

(10) Patent No.: US 8,510,870 B2
(45) Date of Patent: Aug. 20, 2013

(54) ADJUSTABLE HELMET AND RELATED METHOD OF USE

(75) Inventors: David C. Rogers, Boston, MA (US); Kyle L. Lamson, Chelmsford, MA (US); Neil E. Wensley, Rochester, MI (US); Kyle A. Walters, Boston, MA (US)

(73) Assignee: Warrior Sports, Inc., Warren, MI (US)

( * ) Notice: Subject to any disclaimer, the term of this patent is extended or adjusted under 35 U.S.C. 154(b) by 821 days.

(21) Appl. No.: 12/548,007

(22) Filed: Aug. 26, 2009

(65) Prior Publication Data

US 2011/0047679 A1 Mar. 3, 2011

(51) Int. Cl.
*A42B 1/22* (2006.01)

(52) U.S. Cl.
USPC ..... 2/418; 2/417

(58) Field of Classification Search
USPC ..... 2/417–420, 425, 414
See application file for complete search history.

(56) References Cited

U.S. PATENT DOCUMENTS

| | | | | |
|---|---|---|---|---|
| 1,522,952 | A * | 1/1925 | Goldsmith | 2/414 |
| 1,652,145 | A | 12/1927 | Lipschutz | |
| RE17,064 | E | 8/1928 | Fischer | |
| 2,106,570 | A | 1/1938 | Lipton | |
| 2,342,501 | A * | 2/1944 | Strauss | 2/417 |
| 2,698,945 | A | 1/1955 | Hamilton | |
| 3,105,240 | A | 10/1963 | Jansson | |
| 3,665,514 | A | 5/1972 | Durand | |
| 4,404,690 | A * | 9/1983 | Farquharson | 2/420 |
| 4,477,929 | A | 10/1984 | Mattsson | |
| 4,539,715 | A | 9/1985 | Clement | |
| 4,827,537 | A | 5/1989 | Villa | |
| 4,843,642 | A | 7/1989 | Brower | |
| 4,864,662 | A | 9/1989 | Frank | |
| 5,271,103 | A | 12/1993 | Darnell | |
| 5,515,546 | A | 5/1996 | Shifrin | |

(Continued)

FOREIGN PATENT DOCUMENTS

| | | |
|---|---|---|
| WO | 9929199 | 6/1999 |
| WO | 03077693 | 9/2003 |
| WO | 2009024330 | 2/2009 |

OTHER PUBLICATIONS

International Search Report, International Appl. PCT/US2009/055052, International Filing Date Aug. 26, 2009, Mailing Date Apr. 29, 2010.

(Continued)

*Primary Examiner* — Shelley Self
*Assistant Examiner* — Andrew Sutton
(74) *Attorney, Agent, or Firm* — Warner Norcross & Judd LLP

(57) ABSTRACT

A helmet, adjustable longitudinally and laterally to fit a variety of head configurations, includes an outer shell having front and a rear shell parts, which are movably joined with one another, and an adjuster. The rear outer shell and/or the front outer shell can include first and second lateral shell portions separated by a slot. The adjuster can move the first and second lateral shell portions away from one another from a narrowed mode to a widened mode to increase the lateral dimension of the helmet. Simultaneously, the adjuster can move the front and/or rear shell to increase the longitudinal dimension of the helmet as the first and second lateral shell portions move from a narrowed mode to a widened mode. A method is also provided for effecting the longitudinal and lateral adjustments of the helmet.

28 Claims, 12 Drawing Sheets

(56) References Cited

U.S. PATENT DOCUMENTS

| | | | | |
|---|---|---|---|---|
| 5,544,367 | A | 8/1996 | March, II | |
| 5,638,551 | A | 6/1997 | Lallemand | |
| 5,953,761 | A | 9/1999 | Jurga et al. | |
| 5,956,776 | A | 9/1999 | Chartrand | |
| 6,108,824 | A | 8/2000 | Fournier et al. | |
| 6,154,889 | A | 12/2000 | Moore, III et al. | |
| 6,202,223 | B1 | 3/2001 | Chartrand | |
| 6,240,571 | B1 | 6/2001 | Infusino | |
| 6,266,827 | B1 | 7/2001 | Lampe et al. | |
| 6,298,497 | B1 | 10/2001 | Chartrand | |
| 6,324,700 | B1 | 12/2001 | McDougall | |
| 6,385,780 | B1 | 5/2002 | Racine | |
| 6,442,765 | B1 | 9/2002 | Fallon et al. | |
| 6,647,556 | B2 | 11/2003 | Grepper et al. | |
| 6,934,972 | B2 | 8/2005 | Desjardins et al. | |
| 6,966,075 | B2 | 11/2005 | Racine | |
| 6,968,575 | B2 | 11/2005 | Durocher | |
| 6,981,284 | B2 | 1/2006 | Durocher | |
| 7,441,282 | B2 * | 10/2008 | Heine et al. | 2/418 |
| 7,954,178 | B2 | 6/2011 | Durocher et al. | |
| 2002/0007508 | A1 * | 1/2002 | Grepper et al. | 2/420 |
| 2004/0172739 | A1 | 9/2004 | Racine | |
| 2004/0181854 | A1 | 9/2004 | Primrose | |
| 2005/0015857 | A1 | 1/2005 | Desjardins et al. | |
| 2005/0034222 | A1 | 2/2005 | Durocher | |
| 2005/0034223 | A1 | 2/2005 | Durocher | |
| 2005/0257312 | A1 | 11/2005 | Puchalski | |
| 2006/0225187 | A1 * | 10/2006 | Wu | 2/425 |
| 2007/0079429 | A1 | 4/2007 | Pilon et al. | |
| 2007/0266481 | A1 * | 11/2007 | Alexander et al. | 2/414 |
| 2008/0189835 | A1 | 8/2008 | Mangone | |
| 2009/0044315 | A1 | 2/2009 | Belanger et al. | |
| 2009/0151056 | A1 * | 6/2009 | Desjardins et al. | 2/413 |
| 2010/0005573 | A1 | 1/2010 | Rudd et al. | |
| 2010/0050323 | A1 * | 3/2010 | Durocher et al. | 2/414 |
| 2012/0054947 | A1 | 3/2012 | Durocher | |

OTHER PUBLICATIONS

Written Opinion of the International Searching Authority, International Appl. PCT/US2009/055052, International Filing Date Aug. 26, 2009, Mailing Date Apr. 29, 2010.

* cited by examiner

ADJUSTABLE HELMET AND RELATED METHOD OF USE

BACKGROUND OF THE INVENTION

The present invention relates to an adjustable helmet, and more particularly, to a helmet having an exterior shell that is adjustable laterally and longitudinally.

A variety of helmets are commercially available. Most helmets that are adapted to be worn in sporting, recreational and occupational activities include a hard outer shell that forms a portion of the helmet designed to be impacted, padding adapted to fit between the hard outer shell and the head of a wearer, and in some cases, a band that fits around the head of a wearer to hold the hard shell in place relative to the wearer's head.

Many helmets are designed to be adjustable to accommodate a variety of head sizes and shapes. This adjustability is usually provided in the form of an mechanism that adjusts some component of the helmet, internal to the hard outer shell. For example, many hard hats include a one piece, hard outer shell and a head band that is designed to circumferentiate the head of a wearer. The head band is outfitted with a rotatable dial that shortens or lengthens the band via a rack and pinion mechanism to approximate the circumference of the wearer's head. This type of internal adjustability is helpful, but does nothing to adjust the dimensions of the hard outer shell of the hard hat, which is also referred to as a "helmet" herein. Accordingly, the profile of the hard outer shell remains unchanged, which can present comfort and fit issues for the wearer, and can leave the wearer with a helmet that appears too large for their head—despite "fitting" their head on the inside of the helmet.

Other helmets have alternative designs that enable the hard outer shell to be adjusted from front to back, or longitudinally. An example of these helmets are found in the sport of hockey. Most hockey helmets include a front shell covering the crown and temples of a wearer's head, and a rear shell that covers the sides and the rear of the head. The front shell and rear shell are joined with screws that enable a wearer to adjust the longitudinal (front-to-back) dimension of the helmet. After the adjustment, the user can tighten the screws so that the front and rear shells remain joined in a fixed configuration. While this construction is helpful, it requires the use of tools to make the lengthwise adjustment.

Some more recent helmets, such as that disclosed in U.S. Pat. No. 6,108,824 to Fournier, include manually operable features (that is, no tools are required) to adjust the lengthwise dimensions of the helmet. Even helmets like that in Fournier, however have downsides. For example, while the longitudinal dimensions are adjustable, the helmet is not laterally adjustable. For those with large, wide heads, the typical longitudinally adjustable helmet does not address all fitment issues.

In the bicycle helmet industry, there are helmets that provide longitudinal and lateral dimension adjustment. For example, U.S. Pat. No. 6,647,556 to Grepper illustrates a bicycle helmet including an internal screw mechanism that is joined with guides embedded in different parts of the helmet. When the screws are turned, the guides cause separation of the helmet parts, changing the longitudinal and lateral dimensions of the helmet. While this is useful, the screws require tools for adjustment, the actuating mechanism is relatively complex and appears hard to assemble, and the helmet, when expanded, includes wide-open gaps. These gaps can be easily penetrated by objects that impact the head of a wearer. Thus, such adjustable bicycle helmets are not of much use in sporting, recreational or occupational activities where objects such as sticks are used.

While there are a variety of adjustable helmets currently available, there remains much room to provide improved fully and easily adjustable helmets.

SUMMARY OF THE INVENTION

A helmet is provided which is adjustable longitudinally and laterally to fit a variety of head configurations.

In one embodiment, the helmet includes an outer shell having front and a rear shell parts, which are movably joined with one another, and an adjuster. The rear outer shell and/or the front outer shell can include first and second lateral shell portions separated by a slot. The adjuster can move the first and second lateral shell portions away from one another from a narrowed mode to a widened mode to increase the lateral dimension of the helmet. The adjuster also can move at least one of the front shell and the rear shell relative to the other to increase the longitudinal dimension of the helmet as the first and second lateral shell portions move from the narrowed mode to the widened mode.

In another embodiment, the adjuster can be configured to simultaneously increase and/or decrease the lateral and longitudinal dimensions of the helmet. Optionally, the increase or decrease in the longitudinal dimension of the helmet can be proportional to, or can be non-proportional relative to, the increase or decrease in the lateral dimensions of the helmet provided by the adjuster.

In yet another embodiment, the adjuster can be manually operable without the use of tools. Optionally, the adjuster includes a manually rotatable or movable dial or knob, which can actuate the adjuster, and cause it to move the respective portions of the helmet in the desired manner. Further optionally, the helmet can include fasteners, which can secure the respective shell portions in a fixed, immovable configuration after desired manual longitudinal and/or lateral adjustments have been made.

In still another embodiment, the helmet can include a base with the adjuster joined with the base. The base can form a part of the outer shell, and can be joined with the rear shell. In general, the front and rear shells can move relative to the base to provide the longitudinal and lateral dimension adjustment.

In a further embodiment, the base can include a slot cover that extends over and conceals the slot so that foreign objects are impaired and/or prevented from passing through the slot.

In yet a further embodiment, the adjuster includes a strap that extends forwardly to the front shell so that the strap can push the front shell away from the base.

In still a further embodiment, the adjuster includes a manually rotatable dial joined with a rack and pinion mechanism that engages the strap, wherein rotation of the dial extends and retracts the strap relative to the adjuster.

In another, further embodiment, a method is provided that includes providing a helmet including an adjuster, a front outer shell and a rear outer shell movably joined with the front outer shell. The front outer shell and/or the rear outer shell include first and second lateral shell portions separated by a slot. The adjuster is operated to move the first and second lateral shell portions away from one another from a narrowed mode to a widened mode to increase the lateral dimension of the helmet, and to optionally simultaneously move the front shell forward relative to the rear shell to increase the longitudinal dimension of the helmet as the first and second lateral shell portions move from a narrowed mode to a widened mode.

The helmet described herein enables a wearer to alter both the longitudinal and lateral dimensions of the helmet to ensure a comfortable and safe fit. For example, where the profile of the outer shell of the helmet can be adjusted, the wearer can experience a better fit, and an exceptional level of safety. Where included, the manually operable adjuster can enable a wearer to make the desired adjustments while the helmet is on the wearer's head, without the use of tools. This can eliminate repeated trial and error fitment issues common with conventional helmets. Further, where the adjuster adjusts one dimension, then continues to adjust another dimension, a good fit along the latter dimension can also be achieved. In cases where the slot cover is included, the slot that contributes to lateral adjustment can be covered to prevent objects from penetrating the slot and impacting the wearer's head.

These and other objects, advantages, and features of the invention will be more fully understood and appreciated by reference to the description of the current embodiment and the drawings.

DESCRIPTION OF THE CURRENT EMBODIMENT

I. Overview

Figure 1:
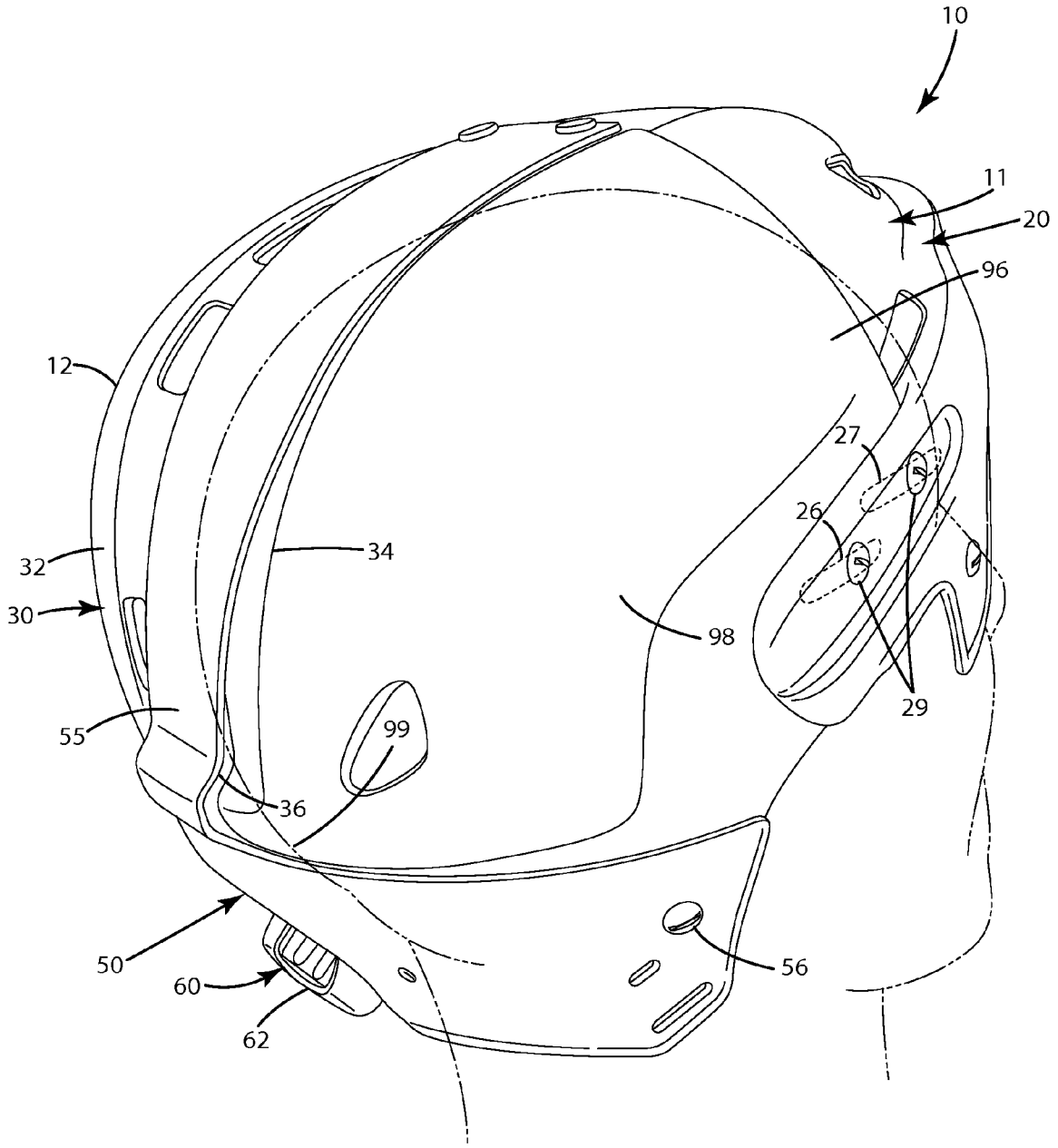
FIG. 1 is a rear perspective view of a helmet of a current embodiment.
Figure 4:
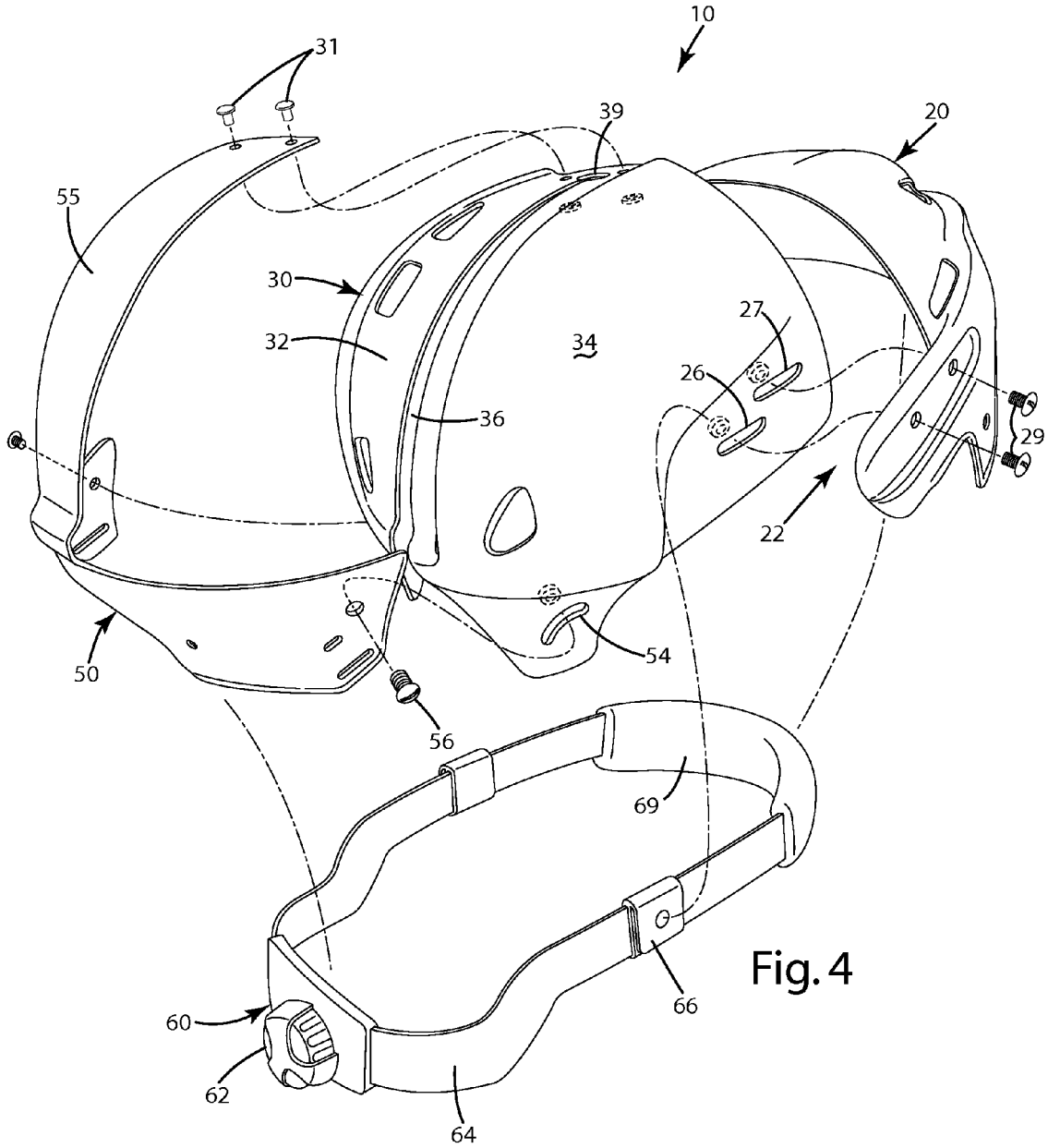
FIG. 4 is an exploded perspective view of the helmet.
Figure 5:
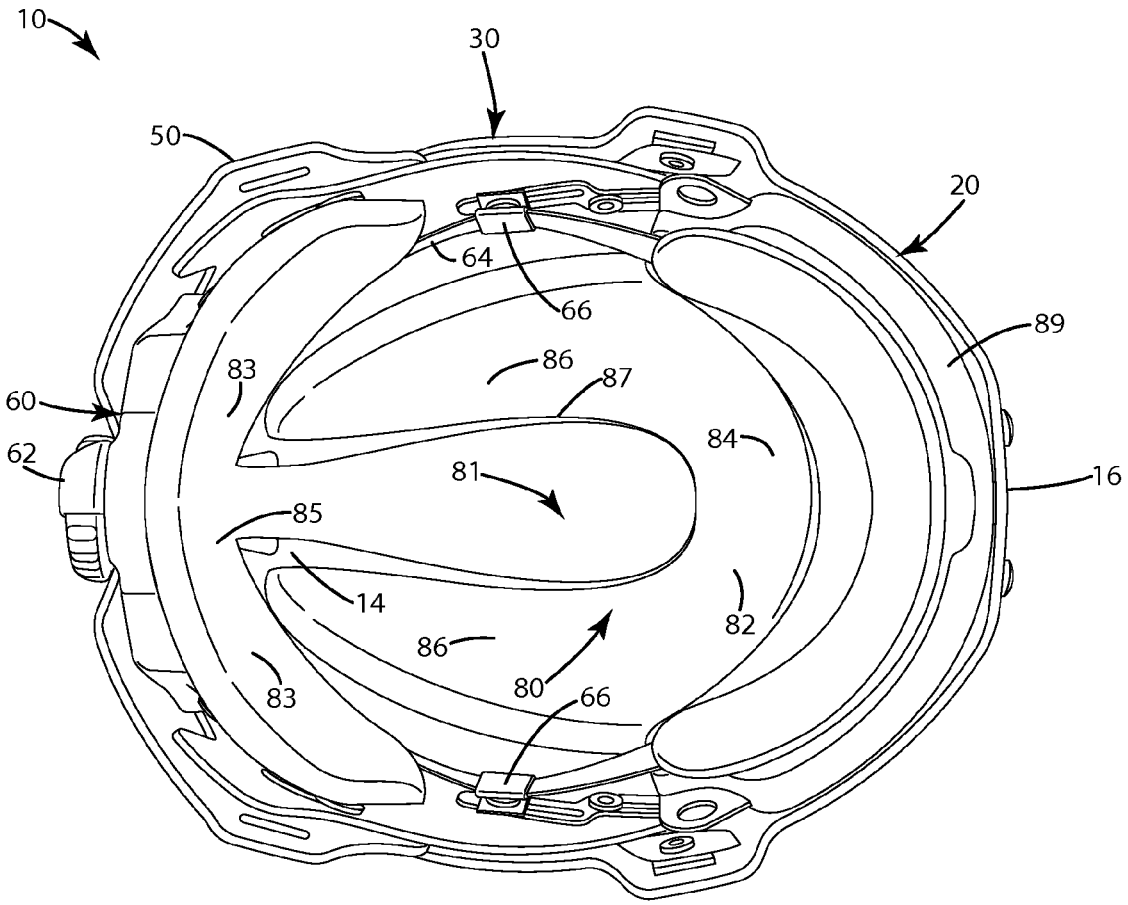
FIG. 5 is an interior bottom view of the helmet with partial interior padding.
Figure 6:
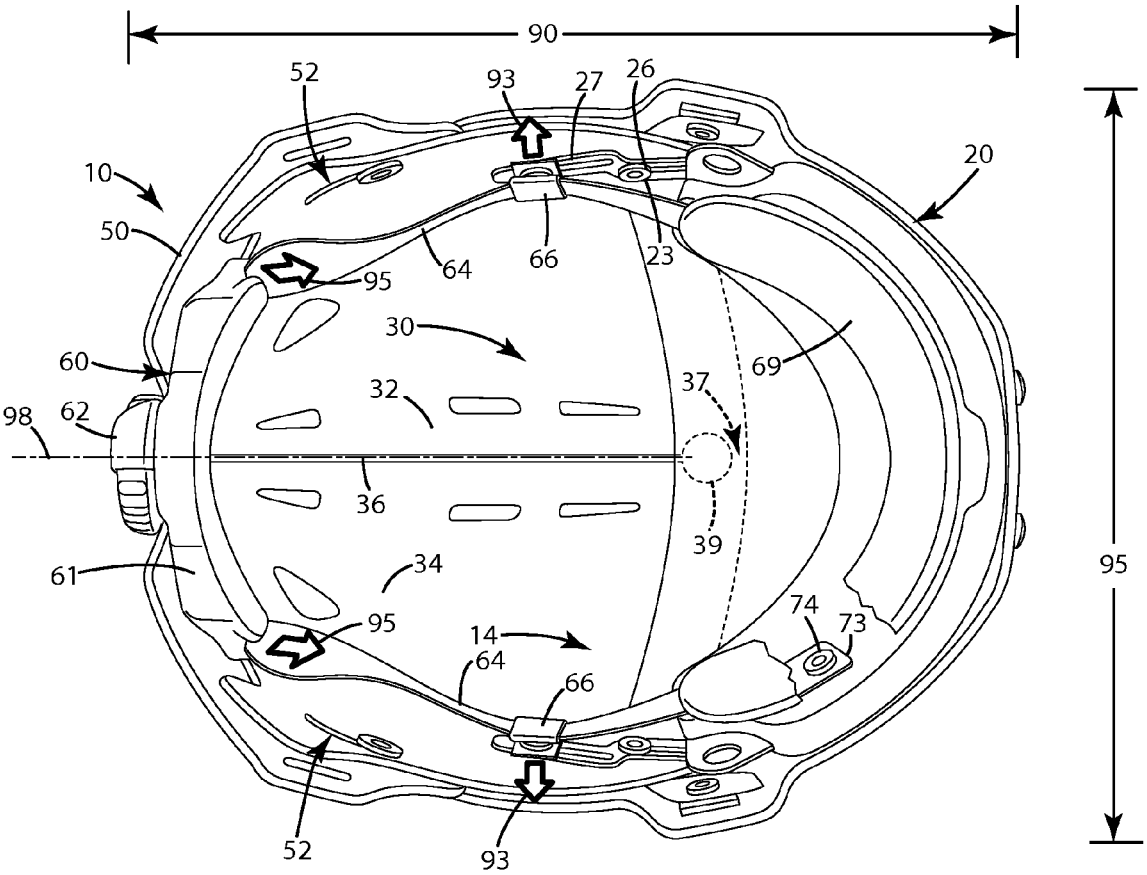
FIG. 6 is an interior bottom view of the helmet without padding, where lateral portions are in a narrowed mode and the front and rear shells are in a shortened longitudinal mode.
Figure 7:
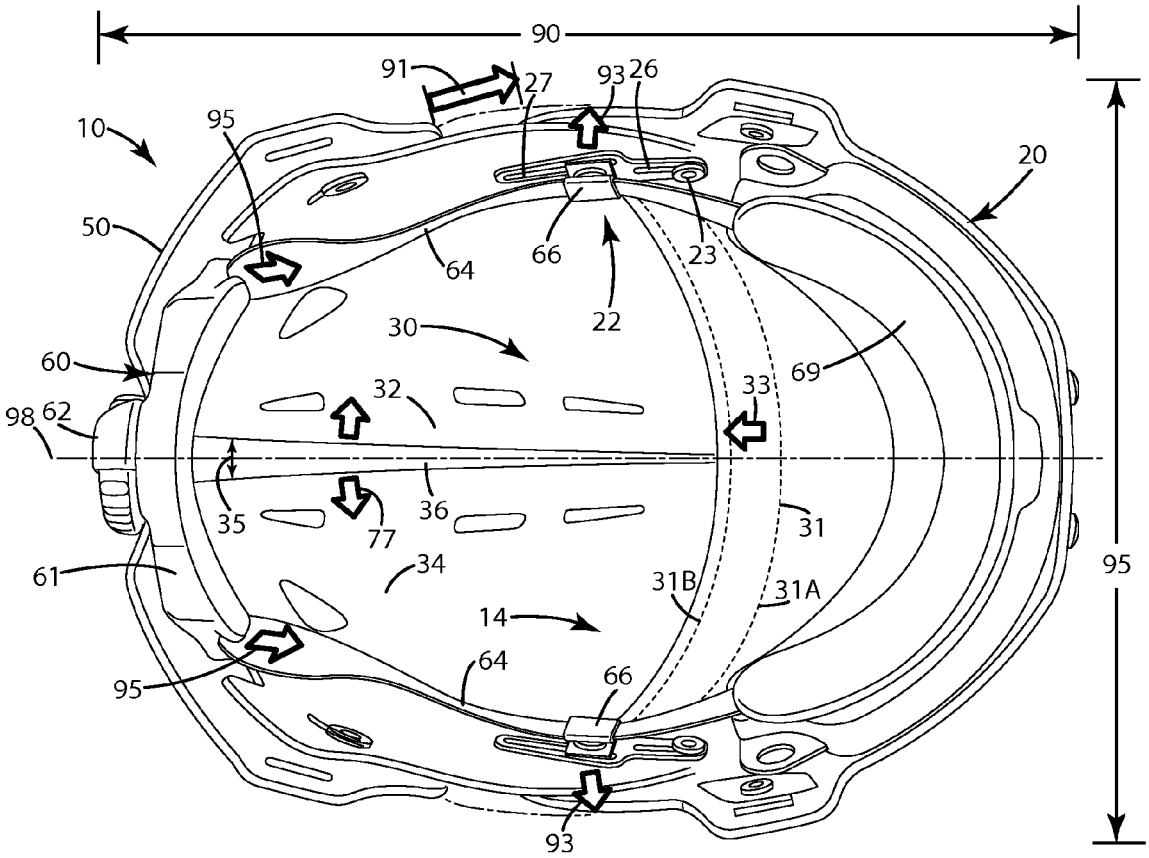
FIG. 7 is an interior bottom view of the helmet without padding, where lateral portions are in a widened mode and the front and rear shells are in a lengthened longitudinal mode.

A current embodiment of an exemplary helmet is shown in FIGS. 1-11 and generally designated 10. The helmet includes a longitudinal dimension 90 generally extending from the front of the helmet to the back of the helmet, and a lateral dimension 95 generally extending side-to-side of the helmet 10 (FIGS. 6, 7). The helmet is designed to fit on a wearer's head, which as shown in FIG. 1, includes a frontal region 96, side regions 98, and a rear region 99.

The helmet 10 can include a hard outer helmet shell 12, which as shown, includes a front shell 20 and a rear shell 30 slidably joined with one another. The rear shell can include first 32 and second 34 lateral portions at least partially separated from one another by a slot 36 extending longitudinally from the rear region toward the frontal region when the helmet 10 is on a wearer's head. The helmet can also include a shell base 50 joined with the rear shell 30. The shell base can include an adjuster 60 including a manually operable dial or knob 62 and a strap 64 extending from the adjuster 60, along the rear shell 30, and forwardly to the front shell 20.

Figure 3:
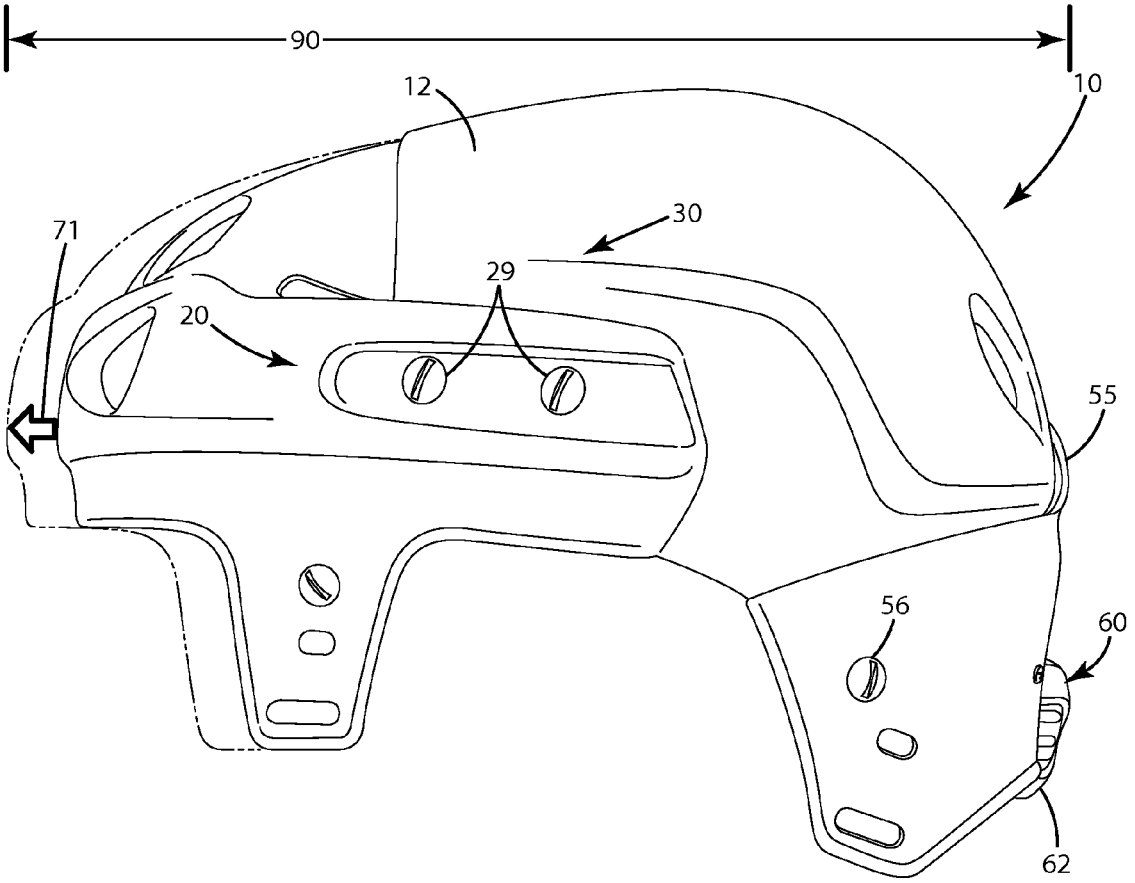
FIG. 3 is a side view of the helmet.

By manually operating the dial 62, the strap 64 can extend and retract relative to the adjuster 60. In doing so, the strap moves the first and second lateral portions 32, 34 away from one another in the direction of arrows 77, widening the slot 36, and reconfiguring the portions 32, 34 from the narrowed mode shown in FIG. 6 toward the widened mode shown in FIG. 7. This, in turn, increases the lateral dimension 95 of the exterior or outer shell 11. The extension of the strap 64 can also, optionally simultaneously, slide the front shell 20 forwardly, away from the base 50, so as to increase the longitudinal dimension 90 of the shell 11, as shown in FIGS. 3 and 7. Optionally, the adjuster can be configured to continue to increase the longitudinal dimension 90 of the helmet 10 after moving the first and second lateral portions 32, 34 from the narrowed mode to the widened mode. To reduce the dimensions 90, 95, the adjuster dial 62 can be rotated in an opposite direction to retract the strap 64, thereby causing the front shell 20 to move toward the rear shell 30, and optionally causing the lateral portions 32,34 to move toward one another from a widened mode (or at least partially widened mode) toward the narrowed mode, thereby closing the slot.

As used herein, "helmet" refers to any headgear designed to be worn on a wearer's head, and includes but is not limited to sporting helmets, such as hockey helmets, lacrosse helmets, football helmets, baseball helmets, etc., occupational helmets such as hard hats, military helmets, and recreational helmets, regardless of construction or the materials from which the helmets are made.

II. Construction

A helmet 10 in accordance with a current embodiment will now be described in more detail with reference to FIGS. 1-11. As illustrated there, the helmet is a hockey helmet; however, as noted above, the features described herein are well suited for virtually any type of helmet. The helmet 10 generally includes longitudinal 90 and lateral 95 dimensions, as shown in FIGS. 3, 6 and 7. The helmet also includes a longitudinal axis 98 which extends through the center of the helmet from front to back, generally bisecting the helmet into equally sized halves.

The helmet can include an outer shell 11 including a front shell 20 and a rear shell 30. The front and rear shells can be connected to one another, and in general, can be movable relative to one another. The shells can be constructed from a hard or rigid materials designed to take an impact and distribute the forces from the impact to optional padding on the interior of the helmet. Suitable materials include, but are not limited to, polycarbonates, nylon, thermoplastics, resins, metals, alloys, carbon fibers, and other materials. The front and rear shells 20 and 30 can be of a desired aesthetic configuration, and can include a predetermined number of ventilation apertures to provide added comfort by enabling air to circulate around the head of the wearer.

Figure 10:
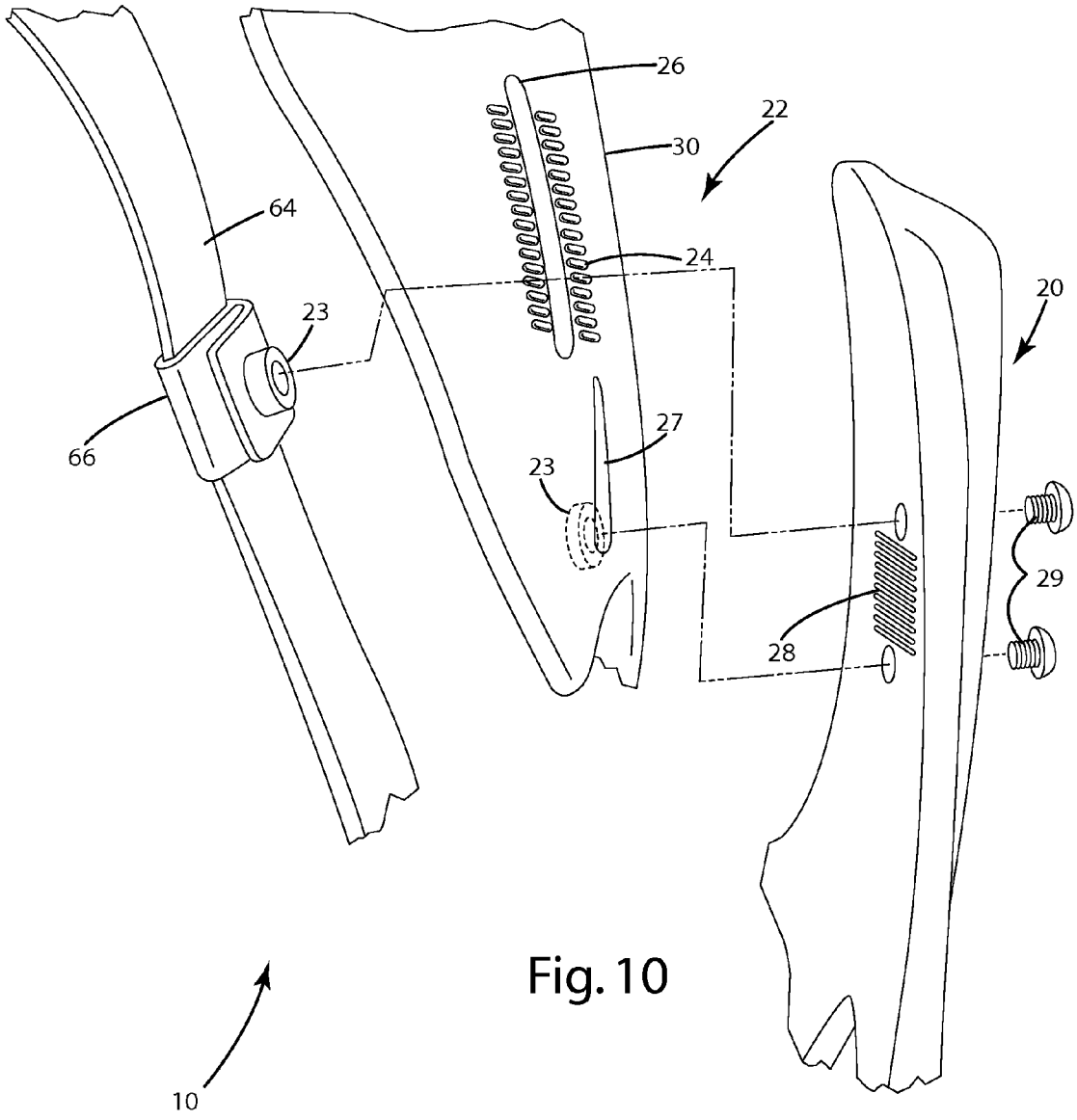
FIG. 10 is an exploded view of an interface between a front shell and a rear shell of the helmet.

As illustrated in FIGS. 3 and 7, the front shell 20 and rear shell 30 can move in relation to one another to adjust the size of the helmet 10, or specifically, to adjust the longitudinal 90 dimension of the helmet. The front and rear shells 20 and 30 can be moved relative to one another primarily with the adjuster 60 (described below); however, the shells can also be fixed relative to one another with a secondary longitudinal locking mechanism 22, as shown in FIG. 10.

The secondary longitudinal locking mechanism 22 optionally can join the front 20 and rear 30 shells in a fixed, and immovable configuration after a wearer manually adjusts the longitudinal dimension 90 of the helmet a desired amount, for example, by sliding the front shell 20 relative to the rear shell 30 to increase the longitudinal dimension of the helmet 10. FIG. 3 illustrates with arrow 71 movement of front shell 20 to increase the longitudinal dimension 90.

The secondary longitudinal locking mechanism 22 can include slots 26 and 27 defined by the rear shell 30, a set of ribs 24 on the rear shell 30 that is designed to interlock with corresponding ribs 28 on the front shell 20, and fastening elements 29, 23 that further interlock the ribs and hold the shells in a desired configuration. Optionally, the ribs 24 and 28 can be replaced with any suitable interlocking mechanism to provide a friction or structural interlocking to prevent forward and rearward movement of the front shell 20 relative to the rear shell 30.

The slots 26 and 27 can be generally linear or curvilinear in structure. Further, the slots can be angled upwardly relative to a horizontal plane as shown in FIG. 1, so that the rear shell raises relative to the front shell as the longitudinal dimension increases.

Although shown as screws 29 that interfit with nuts 23, the fastening elements can be replaced with any suitable fastener such as bolts, cam locks, and the like. The fastening elements also can be designed to be joined with the adjuster 60, and in particular, the adjuster straps 64. For example, one of the nuts 23 can be fixedly joined with the strap guide 66. If desired, however, the secondary locking mechanism 20 can be absent altogether from the helmet.

With reference to FIG. 5, the helmet 10 optionally can include internal padding disposed on the inner surface 14 of the helmet 10. The padding 80 can include a first inner pad 82 that includes a front portion 84 and side portions 86. The side portions 86 can be separated by a recess 87 that runs along the longitudinal axis of the helmet. The padding 80 can also include a front pad 82, which can be connected directly to the front shell 20 via an adhesive or a hook and loop fastening system, rivets, buttons or other suitable fasteners.

The padding 80 can further include a rear inner pad 85 configured to wrap around the interior surface 14 of the rear shell 30. In general, the rear inner pad 85 can include a central portion 81 and wing portions 83, which extend generally adjacent the lateral portions of the helmet. The central portion 81 can interfit within the recess 87 defined by the front inner pad 82 so that the central portion 81 can slide forward and rearward within the recess relatively freely, yet still provide impact absorption on the top of the wearer's head. Optionally, the wing portions 83 of the rear inner pad 85 can be joined with and cover the adjuster 60 and/or other portions of the base 50. Further optionally, the rear inner pad 85 can be of a continuous piece, with a central portion and wings generally being integral and immovable relative to one another, generally covering the occipital, rear region and top region of a wearer's head as desired.

The front shell 20 optionally can include an additional impact absorption element 89, generally transversing the front of the helmet where most impacts occur. This impact absorption element 89 can be fixedly secured to the front shell 20 using conventional fasteners. The impact absorption element can also be fixedly joined with ends 73 of the adjuster strap 64 as described below in detail with reference to FIG. 6.

The inner padding 80 and the impact absorption element 89 can be constructed of any shock absorbing material, for example, expanded polypropylene, expanded polyethylene, vinyl nitrile, polyurethane and/or polystyrene. Further, these components can be joined with the interior surface 14 of the shell 11 with any suitable fastening agents, such as glue, adhesives, tacks, staples, screws, rivets and/or hook and loop fasteners. As desired, additional comfort liners also can be secured between the rear inner pad 85 and the front padding 80 and/or front impact absorption material 89. Although not shown, these elements can be placed to cover the strap 64 as it spans from behind the rear inner pad 85 forwardly to the front shell 20 of the helmet. The comfort liners (not shown) can be secured to the inner surface 14 of the helmet and/or portions of the padding 80 by suitable fastening devices such as glue, adhesives, tacks, staples, rivets and/or screws.

Although not shown, the helmet 10 also can include ear loops and a chin strap attached to the ear loops so that the helmet can be secured to the head of the wearer. If desired, the helmet 10 can also include left and right ear covers to protect the ears of the wearer.

The helmet 10 also includes the rear shell 30 joined with the front shell 20. The rear shell can generally be subdivided into a first lateral portion 32 and a second lateral portion 34. Referring to FIG. 6, the first 32 and second 34 lateral portions are generally disposed on opposite sides of the longitudinal axis 98, which generally bisects the helmet into opposing halves. As will be appreciated, while only two lateral portions are illustrated, the rear shell an be divided into multiple portions, for example a first lateral portion and a second lateral portion, separated from one another by one or more middle portions between the first and second lateral portions between each of the portions. Indeed, the rear shell can be cut or divided into multiple portions that are separated from one another by multiple slots and still be suited to provide for lateral adjustment of the helmet 10. Further, although shown in the rear shell 30, the lateral portions 32 and 34 and the slot 36, alternatively can be included in the front shell 20 to provide adjustment to the lateral dimension 95 of the helmet as desired.

Returning to FIGS. 6 and 7, the first and second lateral portions 32 and 34 are at least partially separated from one another by a slot or slit 36 defined in the rearward region of the helmet 10 near the adjuster 60. As shown in FIG. 6, the slot 36 and lateral portions 32 and 34 are in a narrowed mode, where the slot 36 is very small. Optionally, in this narrowed mode, the edges of the lateral portions 32 and 34 can abut against one another at or near the longitudinal axis 98. In this configuration, the helmet lateral dimension 95 generally is at its minimum. Generally speaking, in this configuration the entire helmet 10 is in a narrowed mode.

The slot 36, however, is adapted to change in dimension via adjustment by the adjuster 60. In so doing, the lateral portions 32 and 34 move away from one another to increase the width 35, thereby opening up the slot 36 from a narrowed configuration to a widened configuration. In making this transition, the lateral portions 32 and 34 move from a narrowed mode to a widened mode, so that the lateral dimension 95 of the helmet 10 also increases.

Figure 8:
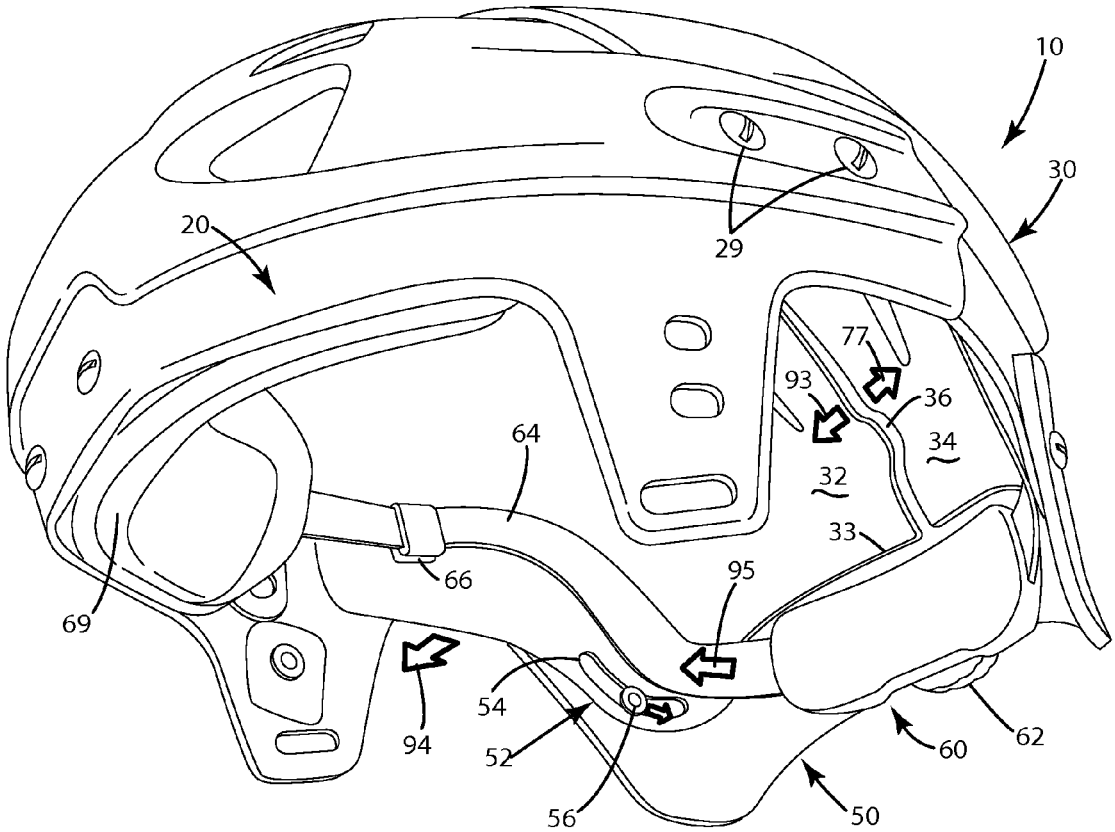
FIG. 8 is an interior view of the helmet expanding from reduced dimensions to increased dimensions
Figure 11:
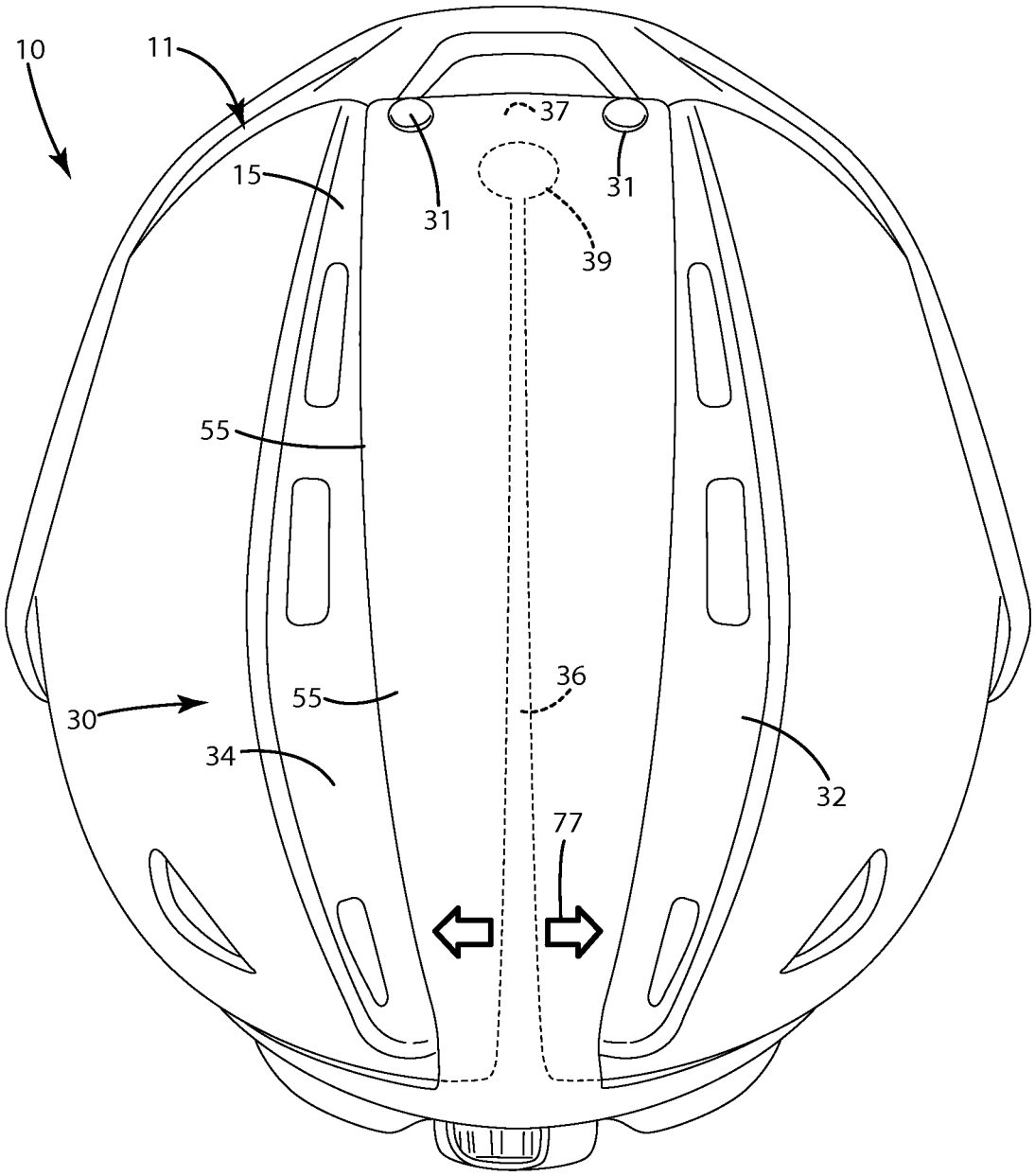
FIG. 11 is a top rear view of the helmet.

As shown in FIG. 8, the slot 36 extends between the lateral portions 32 and 34 to a lower edge 33 of the rear shell 30 in the rear region of the helmet 10. Toward the front region of the helmet, as shown in FIGS. 4 and 11, the slot 36 can terminate at an aperture 39, which can be configured as a circle to reduce potential splitting of the shell at the terminal end of the slot 36. The opposing lateral portions 32 and 34 can be joined adjacent the slot or the aperture 39 via a bridge 37. Optionally, the front terminal end of the slot can be configured in a variety of different geometric shapes. Moreover, the bridge 37 can be absent from the rear shell 30 if desired.

As further explained below, the lateral portions 32 and 34 also can be joined by a slot cover 55, which can be joined to the exterior surface 15 of the shell 11 via rivets, screws or any other suitable fasteners. If desired, the slot cover 55 can be integrally molded with the shell 11.

Figure 9:
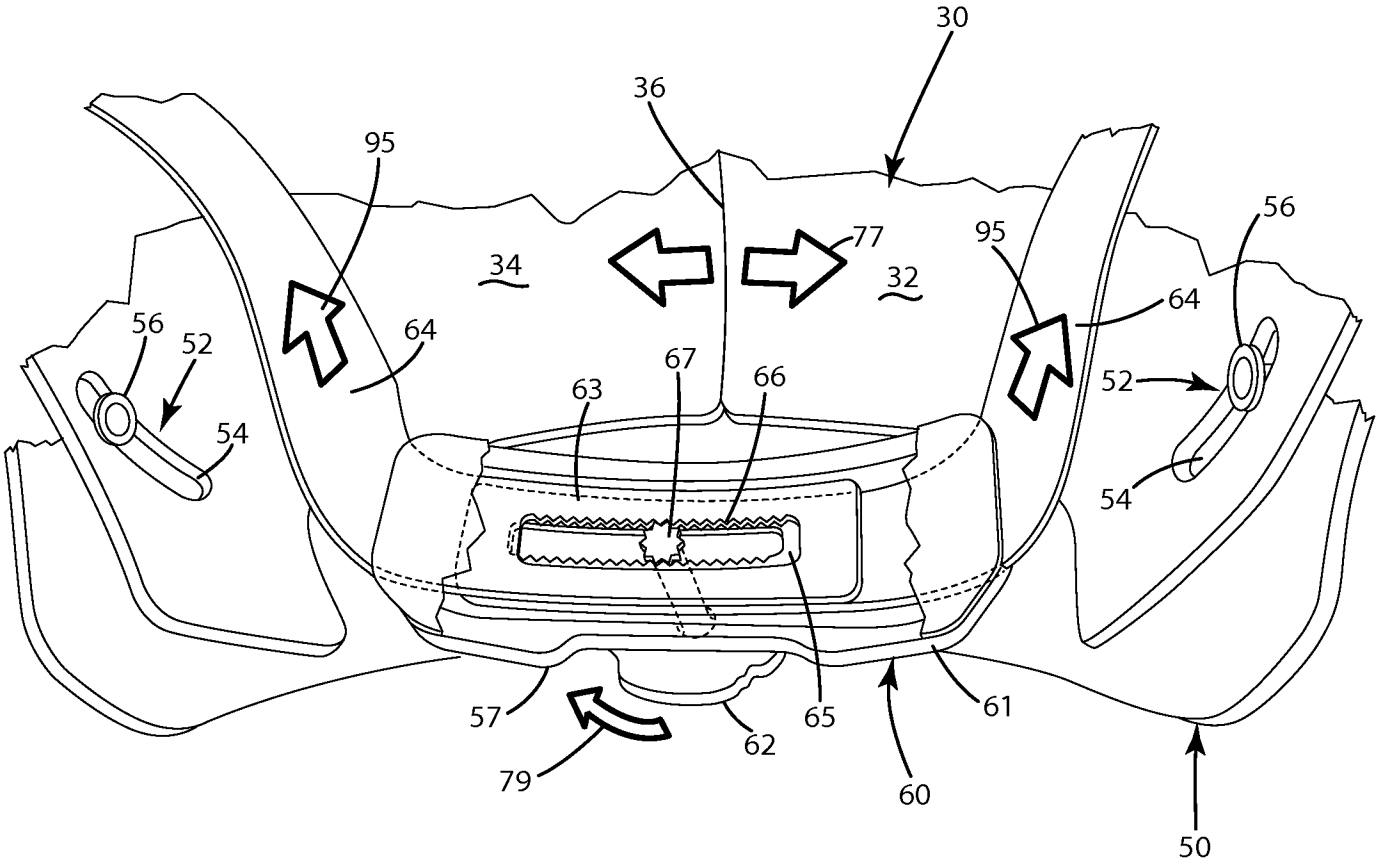
FIG. 9 is an exploded view of an adjuster of the helmet.

The rear shell 30 and base 50 can include optional guide mechanisms to assist in reconfiguration of the lateral portions from a narrowed mode to a widened mode, and vice versa. For example, as shown in FIGS. 8 and 9, at least one of the first and second lateral portions 32 and 34 can include one or more primary guide mechanisms 52, which generally include a primary guide element 54 associated with a lateral portion 32, 34 and a secondary guide element 56 associated with the shell base 50. In FIG. 8, the first lateral portion 32 can include a primary guide element 54, which as illustrated is a guide slot. The slot can be arcuate, curving generally upwardly as it nears the forward portion of the helmet. The configuration of the slot can, of course, be altered so that is generally straight, but optionally angled upwardly as it nears the forward portion of the helmet 10.

The guide mechanism 52 can also include a secondary guide element 56 that engages the guide slot 54. As shown in FIG. 8, the secondary guide element can be a pin 56 slidably received and movable within the guide slot 54. The slot can be configured so that as the guide pin moves within it, the first and second lateral portion 32, 34 move outward, in the direction of arrows 77, away from the longitudinal axis as shown in FIG. 7, translating the first and second lateral portions 32 and 34 from a narrowed mode to a widened mode.

The guide mechanism 52 shown in FIG. 8 on the first lateral portion 32 can also be included on the second lateral portion 34, as illustrated in FIG. 9. Further, although the guide mechanism 52 includes a slot 54 defined by the rear shell 30 and a guide pin joined with the base 50, these components can be reversed, for example the slot 54 can be defined by the base 50, and the pin can be joined with the lateral portion 32. In addition to the slot and pin configuration, a variety of other configurations can be used to provide the same outward and inward guiding of the lateral portions 32 and 34 when the adjuster 60 moves the respective portions. For example, the mechanism 52 can be substituted with a recess in which a projection is guided, or a pair of opposing flanges (not shown) that abut and slide relative to one another to move the lateral portions relative to the shell base 50 or other component of the helmet 10. In addition, guide mechanism 52 can be used as a secondary locking mechanism, in much the same way as secondary locking mechanism 22, to provide a locked position to the lateral adjustment.

The shell base 50 can be joined with the rear shell 30 via the guide mechanism 52, as well as other mechanisms and structures. For example, as shown in FIGS. 1, 4 and 11, the base 50 can also be joined with the rear shell 30 via the slot cover 55, which extends upwardly over at least a portion of the rear shell 30. More particularly, the slot cover 55 can extend upwardly over an exterior surface 15 of the shell 11. The slot cover 55 can be configured to extend adjacent the edges of the first and second lateral portions 32, 34, over at least a portion of the slot 36. Alternatively, the slot cover 55 can be configured so that it extends along the interior surface 14 of the helmet shell 11, adjacent the slot 36 to conceal the slot from the interior of the helmet 10. Regardless of its placement, the slot cover 55 can conceal the slot 36, and impair or prevent objects from passing through the slot, potentially injuring the wearer of the helmet. If the rear shell 30 includes additional slots, additional slot covers can be included as desired, or optionally, a single slot cover can extend over and conceal those multiple slots.

At its forward most portion, the slot cover 55, and indirectly the base 50, can be fixedly and immovably joined with the rear shell 30 via fasteners 31. Suitable fasteners include, but are not limited to, screws, rivets, bolts and clips, as well as adhesives, cements, and the like. Optionally, the components can be integrally molded with one another as desired. Further optionally, the slot cover 55 can be joined with the bridge 37 of the rear shell 30.

Figure 2:
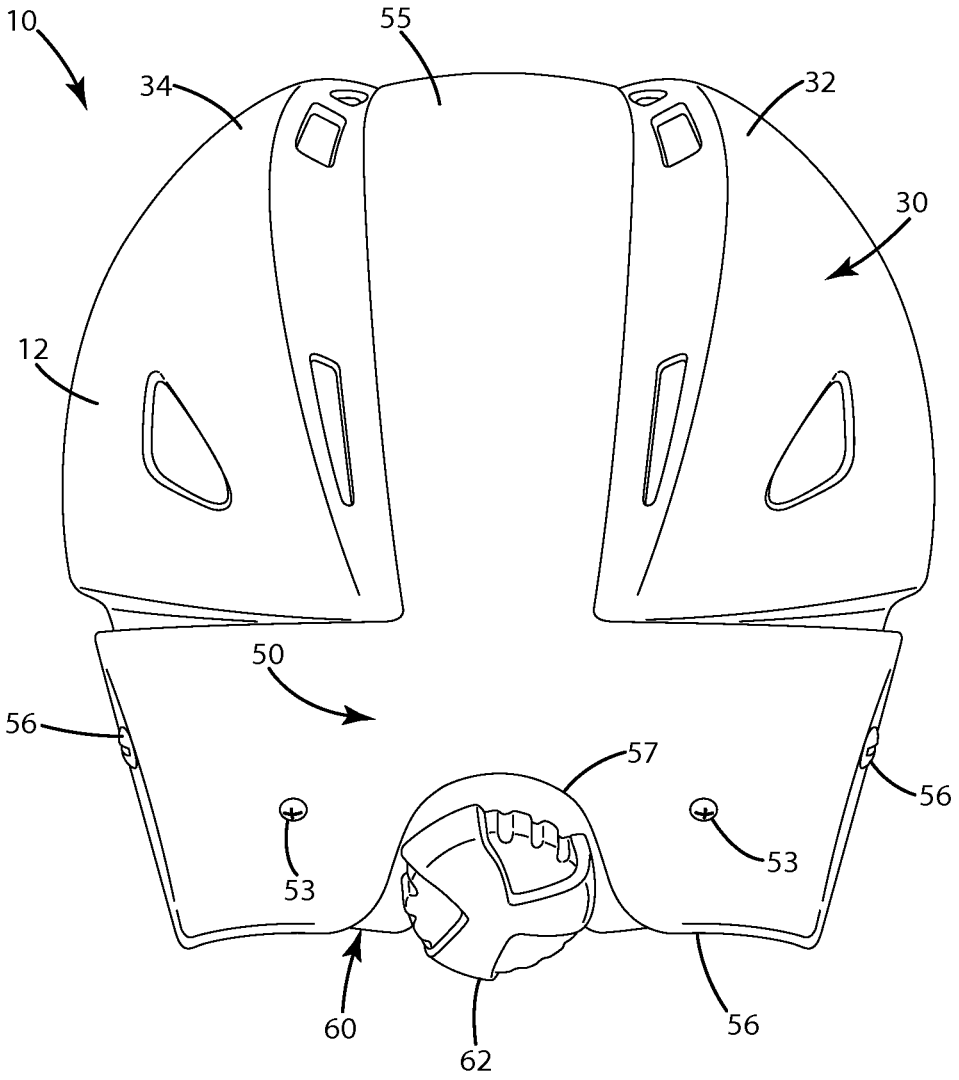
FIG. 2 is a rear view of the helmet.

The outer shell 11 can also include a shell base 50, which generally covers at least a portion of the rear of the wearer's head 99. This shell base 50 can be joined directly to the rear shell 30 as described above, and the adjuster can be joined with the adjuster 60. For example, as shown in FIGS. 2 and 9, a recess 57 can be defined along the lower edge 56 of the base 50. The recess can be configured as a cut out portion of the base 50, so that the at least portion of the adjuster 60, for example, the adjuster element 62, can protrude through the shell base 50 and be manually accessible by a user. Optionally, the recess 57 can simply be a hole defined by the shell base with the adjuster element 62 extending through the hole (not shown). The shell base 50 can optionally further include ridges or projections adjacent the adjuster element 62 to protect the adjuster element from impact.

As shown in FIGS. 1, 2 and 6, the adjuster 60 can be fixedly and immovably joined directly to the shell base 50 with the fasteners 53. Other suitable fasteners include screws, rivets, staples, glue or adhesives. Alternatively, the adjuster 60 can form an integral part of the shell base 50, with at least a portion of the adjuster integrally molded directly on or with the shell base 50.

As illustrated in FIG. 9, the adjuster 60 can include a rack and pinion mechanism that extends and retracts the strap 64, relative to the adjuster 60 to provide adjustment of the lateral and longitudinal dimensions of the helmet 60. In general, the adjuster 60 can include a housing 61 and an adjustment element 62, protruding from the adjuster 60, and generally from the helmet. The adjuster element 62 as shown is a dial or knob that is manually rotatable (without the use of tools). Optionally, the dial can be replaced with any type of manually operable control, such as a switch, a cam lever, a slide or other movable component which can move the desired components of the helmet to perform a dimensional adjustment. Further optionally, the actuation of the adjuster can vary. For example, the adjuster can include an element, such as a nut, screw head or other configuration that is adapted to move upon engagement with a tool. With such a construction, a user can rotate or otherwise move the adjuster by engaging it with an appropriate tool.

As shown in FIG. 9, the adjuster 60 can include a strap 64, which includes ends 63 and 65. The ends 63 and 65 can include rack gears 66 that mesh with a pinion gear 67 which is joined with the adjustment element 62. By rotating the adjustment element 62 in the directions shown by the arrow 79 (or in an opposite direction), the ends 63 and 65 of the strap 64 can move relative to the adjuster housing 61. In general, the strap 64 of the adjuster 60 extends and retracts in response to manual operation of the adjustment element 62. The adjuster itself can be a commercially available adjuster adapted for use with helmet applications. Other suitable adjusters to extend and retract the strap, or otherwise move the lateral portions 32 and 34 and/or the front shell 20 relative to the rear shell 30 can be substituted as desired.

As shown in FIGS. 6, 7 and 9, the adjuster 60 includes a strap 64 that extends forwardly, adjacent the first and second lateral portions 32 and 34 generally along the side regions 98 of a wearer's head. The strap continues to the frontal region 96, where it can be concealed or otherwise covered by a strap inner padding 69 which generally provides padding between the wearer's head and at least a portion of the strap 64 and/or front shell 20. As illustrated in FIG. 6, the strap 64 can terminate at an end 73. That end 73 can be fixedly joined with the front shell via a fastener 74, which as shown is a screw. Of course, other fasteners such as rivets, tacks, glue and/or adhesives can be used as desired. Alternatively, the strap can be molded directly to the front shell 20 as desired.

Optionally, if desired, the strap 64 can be a continuous piece (not shown), and can extend from the adjuster 60 forwardly toward the front shell 20 around the front shell 20, and can return back to the adjuster on the opposite side of the helmet. In this configuration, the strap can be fastened to the front shell in a variety of manners such as those explained above.

Referring to FIGS. 6 and 7, the adjuster 60, via the strap 64, can be joined with strap guides 66 on opposite sides of the helmet 10. The strap guides 66 can be further joined with the rear shell 30, and in particular, the lateral portions 32 and 34. For example, the strap guides 66 can be joined with a nut 23, which is further joined with a fastener 29 as shown in FIG. 10. The strap 64 can be generally immovable relative to the strap guides 66 as desired. Alternatively, the strap 64 can move or otherwise slide relative to the strap guide 66.

III. Method of Operation

A method of operating a current embodiment illustrated in FIGS. 1-11 will now be described. In general, the method of operation includes taking the helmet 10 described above and operating the adjuster 60 to alter the longitudinal 90 and lateral 95 dimensions of the helmet 10. In so doing, the adjuster 60 moves the first and second lateral portions 32, 34 of the helmet 10 away from one another, or toward one another. In doing so, the adjuster widens or narrows (respectively) the slot 36, and configures the first and second lateral portions 32 and 34 from a narrowed mode (FIG. 6) to a widened mode (FIG. 7) or vice versa. This, in turn, increases the lateral dimension 95 of the hard outer shell 11 of the helmet 10. The adjuster 60 also can operate to move, for example, slide the front shell 20 forwardly relative to the rear shell 30, generally away from the base 50, or rearwardly relative to the rear shell, generally toward the base 50. In turn, this increases the longitudinal dimension 90 of the hard outer shell 11, or decreases the longitudinal dimension 90 of the hard outer shell 11, respectively. Optionally, the adjuster is configured to increase the lateral and longitudinal dimensions simultaneously, or nearly simultaneously with one another. More generally, the adjuster adjusts the lateral and longitudinal dimensions independently of one another so that the lateral portions widen and/or narrow, without that movement being driven, or the result of, the longitudinal movement of the shell, or vice versa.

The adjuster 60 can also be configured so that when the lateral adjustment is maximized, that is, the lateral portions 32 and 34 are moved to their most outwardly disposed position, and maximum lateral dimension 95, the adjuster 60 continues to increase the longitudinal dimension of the outer helmet shell. Alternatively, the adjuster 60 can be configured to continue increasing the lateral dimension 95 of the helmet shell 11 after reconfiguring the front 20 and rear 30 shells from a shortened mode to a lengthened mode, that is, after moving the shells to their most extended positions, and maximum longitudinal dimension 90.

Referring specifically to FIGS. 6-9, the adjuster 60 is configured so that the strap 64 engages or generally moves the lateral portions 32 and 34, as well as the front shell 20. In FIG. 6, the helmet 10 is shown in a narrowed mode where the slot 36 is configured so that the lateral portions 32 and 34 are immediately adjacent, optionally abutting, one another. By rotating the adjustment element 62 of the adjuster 60, as shown by arrow 79 in FIG. 9, the strap 64 begins to extend in the direction of the arrows 95 as shown in FIGS. 6. 7 and 9. This movement is provided by the rack and pinion mechanism shown in FIG. 9 of the adjuster 60 engaging the ends 63 and 65 of the strap 64 to extend them relative to the adjuster housing 61. Of course, where other adjuster mechanisms are utilized, the ends 63 and 65 of the strap can be moved in other manners.

As shown in FIGS. 6, 7 and 9, as the strap 64 moves in the direction of arrows 95, the strap engages the strap guides 66. The strap guides 66 are joined directly with the lateral portions 32 and 34. Where the strap guides 66 are immovable or somewhat immovable relative to the shell lateral portions 32 and 34, the strap 64 begins to press against the strap guides 66 thereby pushing the strap guides 66 in the direction of arrows 93 (FIGS. 6 and 7). This produces an outwardly directed force on the lateral portions 32 and 34. As a result, the lateral portions are urged to begin moving from the narrowed mode shown in FIG. 6 to the widened mode shown in FIG. 7, outward, generally away from the longitudinal axis 98.

Referring to FIGS. 8 and 9, the movement of the lateral portions 32 and 34, and the extension of the strap in the direction 95, can be guided by the guide mechanisms 52. For example, the movement of the lateral portions 32, 34 is guided via the respective guide pins 56 moving within the guide slots 54. With the arcuate and/or angled configuration of the guide slot 54, the lateral portions 32, 34 move the outward in the direction of the arrow 77. This, in turn, widens the slot 36, or otherwise increases the width 35 as shown in FIG. 7.

As a result, the helmet in general is reconfigured from a narrowed mode to a widened mode, with the narrowed mode being shown in FIG. 6, and the widened mode being shown in FIG. 7. The actual width 35 to which the slot 36 is reconfigured can vary depending on the application. In general, the widened slot width near the rear edge 33 of the rear shell 30 can range anywhere from a 1/32 inch to 2 inches or more, depending on the amount of adjustability and the maximum lateral dimension 95 of the helmet. Of course, with increased adjustability, the slot becomes larger, so optionally, the dimension of the slot cover concealing the slot can also become larger as desired.

Returning to FIGS. 6 and 7, operation of the adjuster 60 also changes the longitudinal dimension 90 of the helmet, for example, from a shortened mode shown in FIG. 6 to a lengthened mode, shown in FIG. 7, and/or vice versa. Specifically, when the adjustment element 62 is manually adjusted, it extends the strap 64 in the direction 95, as explained above. This extension is translated through the strap 64 to move the front shell 20 of the helmet away from the base 50. Generally, the extending strap 64 effectively pushes against the front shell 20 at the connection of the end 73 to the shell, moving the front shell 20 in the direction of arrow 91, as shown in FIG. 7. The extension of the strap in the forward direction moves the front shell 20 forward relative to the rear shell 30 as also illustrated in FIG. 3, via the arrow 71, showing the front shell moving from a shortened mode (in solid lines) to a lengthened mode (in broken lines).

With reference to FIG. 7, as the front shell 20 begins to move forward in the direction of the arrow 91, the front edge 31 of the rear shell 30 moves relative to the front shell 20. For example, as illustrated, the front edge 31 of the rear shell 30 moves from position 31A to position 31B in the direction of the arrow 33. As the adjuster 60 continues to push the strap 64 against the front shell 20, the front shell moves in the direction of the arrow 91, with the longitudinal dimension 90 of the helmet increasing as a result. As shown in FIGS. 6 and 7, the movement of the front shell 20 relative to the rear shell 30 can be guided by the interaction of the guide screws or pins 29 moving in the guide slots 26 and 27. When the guide pins 29 reach the terminal ends of the guide slots 26 and 27, the adjuster can be impeded from further longitudinal adjustment of the front shell 20 relative to the rear shell 30. In general, the longitudinal dimension 90 can be adjusted in increments ranging from 1/32 inch to 2 inches or more.

The transition of the lateral portions 32 and 34 of the rear shell 30 from an inward mode to an extended mode, or vice versa, can occur nearly simultaneously, or before, or after the longitudinal movement of the front 20 and rear 30 shells relative to one another. In the embodiments shown, the lateral movement of the lateral portions 32 and 34 in the direction of the arrows 77 generally occurs simultaneous to the forward movement of the front shell 20 in the direction of the arrow 91. However, after the strap 64 has been extended sufficiently to move the lateral portions 32 and 34 from the narrowed mode to the extended mode, and to increase the width 35 to its maximum point, continued extension of the strap in direction 95 continues to move the front shell 20 in the direction of the arrow 91. In this manner, the adjuster generally increases the longitudinal dimension 90 of the helmet, after moving the first and second lateral shell portions 32 and 34 from the narrowed mode to the widened mode to adjust the lateral dimension 95.

To explain the adjustment of the helmet another way, with the base shell 50 as a reference area, the various components of the front shell 20 and the rear shell 30 can move relative to the base 50. For example, the adjuster 60, when adjusted, pushes the front shell 20 away from the base 50. This, in turn, causes the front shell 20 to slide relative to the rear shell 30, increasing the longitudinal dimension 90 of the helmet 10. Again using the base 50 as a reference region, the adjuster 60 pushes the lateral portions 32 and 34 outward relative to the base. This, in turn, increases the lateral dimension 95 of the helmet. The adjuster 60 can provide the movement of the front shell 20 and the lateral portions 32, 34 of the rear shell nearly simultaneously or in a sequential manner depending on the configuration of the adjuster and its engagement with the respective components of the shell 11.

The operation of the helmet 10 can be explained in yet another way, for example, from the perspective of the helmet being placed on the head of a wearer for fitting, as show in FIG. 1. The wearer can adjust the adjuster 60 to alter the lateral and longitudinal dimensions 95 and 90 until a comfortable fit is achieved. The wearer can begin a helmet fitting sequence by adjusting the longitudinal and/or lateral dimensions 90 and/or 95 with the adjuster 60 to a starting configuration. In some cases, this starting configuration can be where the lateral and longitudinal dimensions are maximized, that is, where the lateral portions 32 and 34 are in the full, widened mode as shown in FIG. 7, and the front and rear shells are in the fully lengthened mode, as shown in FIG. 3. The user can place the "maximized" helmet 10 on their head. With the helmet on their head, the user can manually rotate, without the use of tools, the adjuster 60 in a clockwise manner as shown by arrow 46 in FIG. 12.

Figure 12:
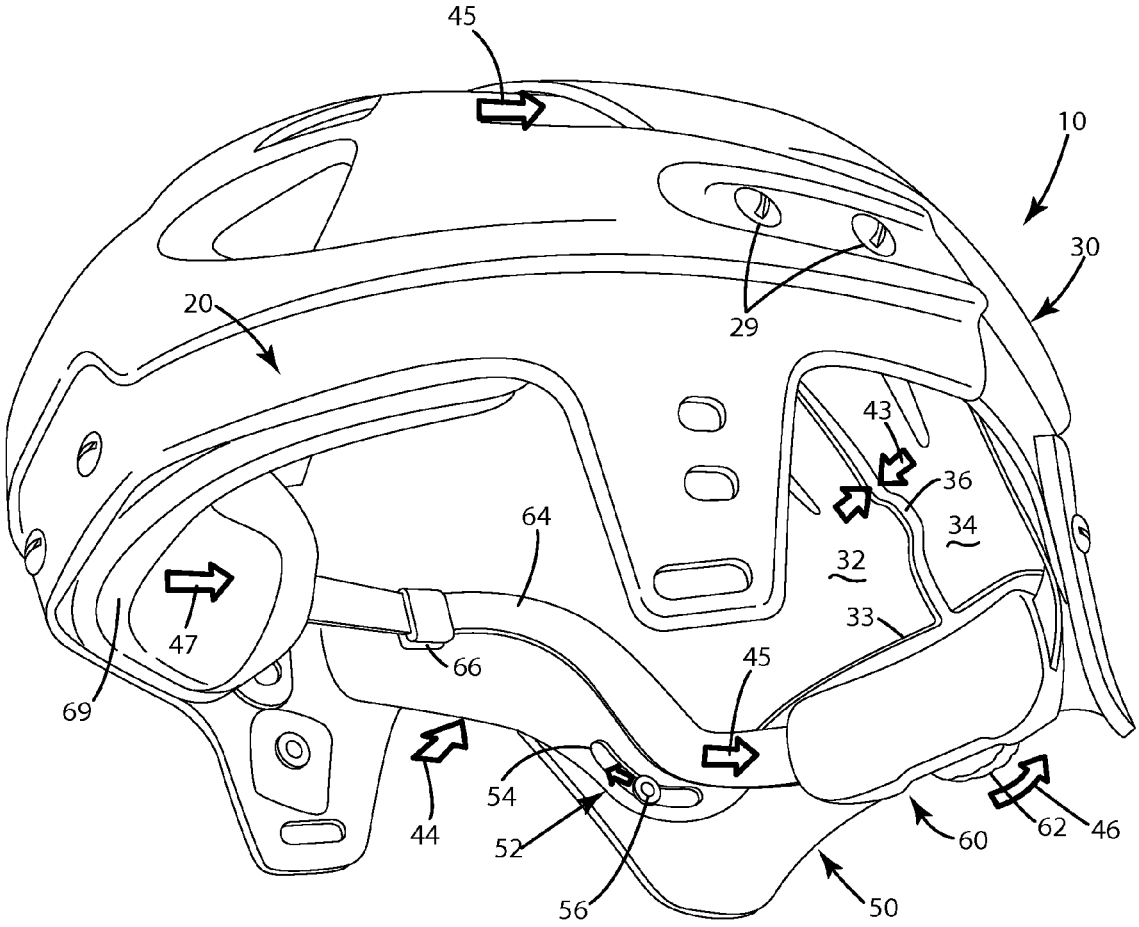
FIG. 12 is an interior view of the helmet being reduced from increased dimensions to reduced dimensions.

As a result of this clockwise rotation, the strap 64 retracts toward the adjuster, in the direction of arrow 45. In so doing, the front shell 20, which is attached to the adjuster via strap 64, moves in the direction of arrows 45 and 47 toward the rear shell 30, and/or base 50 of the helmet 10. Where the strap 64 is attached via strap guide 66, or by other mechanisms, to the lateral portions 32 and 34, the strap 64 pulls the lateral portions 32 and 34 from the widened mode as illustrated in FIG. 12 toward a narrowed mode, as shown in FIG. 6. In general, the lateral portions move toward one another in the direction of arrows 43, to narrow the gap 36 between the lateral portions 32 and 34. The guide mechanism 52 can operate as explained above to guide the lateral portions 32 and 34 toward one another. As the user continues to rotate the adjuster 60, the lateral portions 32 and 34 move toward one another, with the lateral dimensions 95 of the helmet reducing. Optionally, the front shell 20 continues to move in directions 45 and 47 generally toward the rear shell 30 and/or the base 50, which continues to reduce the longitudinal dimension 90 of the helmet. As the dimensions reduce, the helmet 10 begins to become snug on the wearer's head. When the desired snugness of the helmet on the wearer's head is achieved both longitudinally and laterally, the wearer can discontinue manual rotation of the adjuster.

The movement of the front shell 20 toward the rear shell 30 and/or base 50, relative to the movement of the lateral portions 32 and 34, can optionally be proportional. For example, for each increment of longitudinal movement, the adjuster 60 can make a corresponding increment of lateral movement. As a even more particular example, when the adjuster reduces the longitudinal dimensions by 1/4 inch, it can simultaneously reduce the lateral dimension by 1/8 inch by moving the lateral portion closer to one another by that distance. The precise proportioning of movement can vary as desired. Furthermore, the adjuster 60 can move the helmet components to adjust the lateral and/or longitudinal dimensions simultaneously or at different times as explained above.

The adjuster 60 can adjust the longitudinal 90 and lateral 95 dimensions of the helmet 10 nearly infinitely, which can enable the helmet 10 to fit a wide variety of users. This lateral and longitudinal adjustment can be performed while the helmet 10 is on the head of the user, simply by manually adjusting the adjustment element 62. If the user desires to set the helmet components in a fixed, immovable configuration, where the longitudinal 90 and lateral 95 dimensions are fixed for an extended period of time, the user optionally can engage the elements 29, manually or with a tool, to operate the longitudinal locking mechanisms 22 and secure the front shell 20 in a fixed configuration relative to the rear shell 30.

The user optionally can also fix the longitudinal dimension 90 of the helmet. To do so, the user can engage the guide pin elements 56, manually or with a tool, to tighten those elements and secure the base 50 in a fixed immovable configuration relative to the lateral portions 32 and 34 of the rear shell 30. In this manner, with the base 50 and rear shell 30 in a fixed immovable configuration, the lateral dimension 95 of the helmet is set in a fixed configuration. If a user desires to alter the dimensions 90 and 95 again after tightening the fasteners or elements, the user can loosen those items and then manually engage the adjuster element 62 to reconfigure the helmet 10 and dial the helmet 10 to the desired dimensions.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A helmet for use on a wearer's head having a frontal region, side regions, and a rear region, the helmet comprising:

a hard outer helmet shell including a longitudinal dimension, a lateral dimension, and a longitudinal axis, and a front shell slidably joined with a rear shell, the rear shell including first and second lateral portions at least partially separated from one another by a slot extending longitudinally from the rear region toward the frontal region when on a wearer's head, the first and second lateral portions of the rear shell being configurable in at least one of a narrowed mode and a widened mode;

a hard outer shell base joined with at least one of the front shell and the rear shell, the shell base being adjacent the rear region of the head of the wearer; and an adjuster including a manually operable adjustment element and a strap extending from the adjuster, the adjuster adapted to extend and retract at least a portion of the strap in response to manual operation of the adjustment element, the adjuster joined with the shell base, the strap extending forwardly and joined with the front shell, the strap adapted to move at least one of the first lateral portion and second lateral portion away from one another, to widen the slot, and to configure the first and second lateral portions from the narrowed mode to the widened mode so as to increase the lateral dimension of the hard outer shell, the strap adapted to slide the front shell forwardly, away from the base member so as to increase the longitudinal dimension of the hard outer shell;

wherein the first and second lateral portions are pivotally joined with at least one of one another, the front shell, and the rear shell;

wherein the first and second lateral portions pivot as the first and second lateral portions configure from the narrowed mode to the widened mode.

2. The helmet of claim 1 wherein the shell base includes a slot cover that extends adjacent the first and second lateral portions and that conceals the slot so that objects are impaired from passing through the slot.

3. The helmet of claim 2 wherein the adjuster engages the strap via a rack and pinion mechanism.

4. The helmet of claim 3 wherein the strap includes first and second ends which the adjuster engages, wherein the strap extends from the rear region of the wearer's head, along the side regions of the head, and around the frontal region of the wearer's head.

5. The helmet of claim 3 wherein the strap circumferentiates at least a portion of the wearer's head.

6. The helmet of claim 1 wherein the adjuster extends the strap to push the front shell forwardly, away from the shell base.

7. The helmet of claim 1 wherein the first lateral portion includes a primary guide element, wherein the shell base includes a secondary guide element, wherein the primary guide element slidably engages the secondary guide element.

8. The helmet of claim 7 wherein the primary guide element is a guide slot, and the secondary guide element is a guide pin, the guide pin being slidably received in the guide slot, the guide slot being configured so that as the guide pin moves relative to the slot, the first lateral portion moves relative to the longitudinal axis of the hard outer helmet shell from the narrowed mode to the widened mode.

9. The helmet of claim 7 wherein the primary guide element is a guide pin, and the secondary guide element is a guide slot, the guide pin being slidably received in the guide slot, the guide slot being configured so that as the guide pin moves relative to the slot, the first lateral portion moves relative to the longitudinal axis of the hard outer helmet shell from the narrowed mode to the widened mode.

10. The helmet of claim 8 wherein the guide slot is an arcuate slot, curving upwardly from the rear region of the head toward the side region of the head.

11. The helmet of claim 1 wherein the shell base includes a slot cover that extends over and conceals the slot so that objects are impaired from passing through the slot, wherein the slot cover is fixedly joined with the bridge on an exterior of the hard outer helmet shell.

12. The helmet of claim 1 wherein the strap is adapted to continue to increase the longitudinal dimension of the hard outer shell after the strap configures the first and second lateral portions from the narrowed mode to the widened mode.

13. A helmet comprising:

an outer helmet shell including a longitudinal dimension and a lateral dimension, and a front shell slidably joined with a rear shell, the rear shell including first and second lateral portions at least partially separated from one another by a longitudinal slot, the first and second lateral portions being configurable in at least one of a narrowed mode and a widened mode;

a base joined with at least one of the front shell and the rear shell; and an adjuster joined with the base, the adjuster manually operable without the use of tools, the adjuster configured to move at least one of the first lateral portion and second lateral portion of the outer helmet shell away from one another, to widen the slot, and to configure the first and second lateral portions from the narrowed mode to the widened mode so as to increase the lateral dimension of the hard outer helmet shell, the adjuster further configured to slide the front shell forwardly, away from the base, to increase the longitudinal dimension of the hard outer helmet shell;

wherein the slot is centrally located between the first and second lateral portions, in the middle of a wearer's head from left to right, when the helmet is worn by a wearer;

wherein the first and second lateral portions are pivotally joined with at least one of one another, the front shell, and the rear shell;

wherein the first and second lateral portions pivot as the first and second lateral portions configure from the narrowed mode to the widened mode.

14. The helmet of claim 13 wherein the adjuster alters the longitudinal dimension of the outer helmet shell simultaneously while moving the first and second lateral portions from the narrowed mode to the widened mode.

15. The helmet of claim 13 wherein the adjuster includes a strap that extends forwardly to the front shell, the strap adapted to move the front shell away from the base.

16. The helmet of claim 15 comprising padding disposed within the outer helmet shell, the padding at least partially covering the slot inside the outer shell.

17. The helmet of claim 13 wherein the adjuster includes a manually rotatable dial joined with a rack and pinion mechanism that engages a strap, wherein rotation of the dial extends and retracts the strap relative to the adjuster, wherein the strap, when extended, moves the front shell away from the base.

18. The helmet of claim 13 wherein the base includes a includes a first primary guide element that engages a first secondary guide element of the first lateral portion, and a second primary guide element that engages a second secondary guide element of the second lateral portion.

19. The helmet of claim 18 wherein the adjuster includes a strap that moves the first and second lateral portions so that the first primary guide element engages the first secondary guide element of the first lateral portion, wherein the second primary guide element engages the second secondary guide element of the second lateral portion, wherein the second lateral portion and first lateral portion move away from one another.

20. A helmet having a lateral dimension and a longitudinal dimension, the helmet comprising:

a front outer shell;

a rear outer shell, slidably joined with the front outer shell, at least one of the front outer shell and rear outer shell including first and second lateral shell portions at least partially separated from one another by a slot having a width;

an adjuster, manually operable without the use of tools, joined with at least one of the front outer shell and the rear outer shell, the adjuster adapted to move the first and second lateral shell portions away from one another from a narrowed mode to a widened mode to increase the lateral dimension of the helmet and to increase the width of the slot, the adjuster adapted to slide at least one of the front outer shell and the rear outer shell relative to the other to increase the longitudinal dimension of the helmet as the first and second lateral shell portions move from the narrowed mode to the widened mode; and a slot cover joined with at least one of the first lateral shell portion, the second lateral shell portion, the front outer shell, and the rear outer shell, wherein the slot cover extends over and conceals the slot so that objects are impaired from passing through the slot;

wherein the first and second lateral shell portions are pivotally joined with at least one of one another, the front outer shell, and the rear outer shell;

wherein the first and second lateral shell portions pivot as the first and second lateral shell portions configure from the narrowed mode to the widened mode.

21. The helmet of claim 20 wherein at least a portion of the front outer shell overlaps at least a portion of the rear outer shell and at least a portion of the rear outer shell overlaps at least a portion of the front outer shell.

22. The helmet of claim 20 wherein the adjuster is configured to continue to increase the longitudinal dimension of the helmet after moving the first and second lateral shell portions from the narrowed mode to the widened mode.

23. A helmet having a lateral dimension and a longitudinal dimension, the helmet comprising:

a front outer shell;

a rear outer shell, slidably joined with the front outer shell, at least one of the front outer shell and rear outer shell including first and second lateral shell portions at least partially separated from one another by a slot having a width;

an adjuster, manually operable without the use of tools, joined with at least one of the front outer shell and the rear outer shell, the adjuster adapted to move the first and second lateral shell portions away from one another from a narrowed mode to a widened mode to increase the lateral dimension of the helmet and to increase the width of the slot, the adjuster adapted to slide at least one of the front outer shell and the rear outer shell relative to the other to increase the longitudinal dimension of the helmet as the first and second lateral shell portions move from the narrowed mode to the widened mode;

a fastening element joined with the front outer shell and the rear outer shell, the fastening element adapted to join the front outer shell and rear outer shell in a fixed, immovable configuration after the adjuster slides the front outer shell forward relative to the rear outer shell to increase the longitudinal dimension of the helmet; and a shell base, the adjuster joined with the shell base, the shell base joined with the rear outer shell, at least one of the rear outer shell and the shell base including a guide element, the guide element including a secondary fastening element adapted to join the shell base and rear outer shell in a fixed, immovable configuration after the first and second lateral shell portions are moved away from one another from a narrowed mode to a widened mode.

24. A helmet having a lateral dimension and a longitudinal dimension, the helmet comprising:

a front outer shell;

a rear outer shell, slidably joined with the front shell, at least one of the front outer shell and rear outer shell including first and second lateral shell portions at least partially separated from one another by a slot having a width;

an adjuster, manually operable without the use of tools, joined with at least one of the front shell and the rear shell, the adjuster adapted to move the first and second lateral shell portions away from one another from a narrowed mode to a widened mode to increase the lateral dimension of the helmet and to increase the width of the slot, the adjuster adapted to slide at least one of the front shell and the rear shell relative to the other to increase the longitudinal dimension of the helmet as the first and second lateral shell portions move from the narrowed mode to the widened mode; and a shell base joined with the rear shell, the adjuster fixedly mounted to the shell base, the shell base including a slot cover that extends over and conceals the slot so that objects are impaired from passing through the slot.

25. The helmet of claim 24 wherein the slot cover is fixedly joined with an exterior portion of the rear outer shell.

26. A method for adjusting lateral and longitudinal dimensions of a helmet comprising:

providing a helmet including an adjuster, a front outer shell and a rear outer shell slidably joined with the front outer shell, at least one of the front outer shell and the rear outer shell including first and second lateral shell portions at least partially separated from one another by a slot having a width; and operating the adjuster to move the first and second lateral shell portions away from one another from a narrowed mode to a widened mode to increase the lateral dimension of the helmet, and to simultaneously slide the front outer shell forward relative to the rear outer shell to increase the longitudinal dimension of the helmet as the first and second lateral shell portions move from a narrowed mode to a widened mode;

wherein the slot has a varying width, so that the width of the slot adjacent the front outer shell is less than the width of the slot distal from the front outer shell, at a location adjacent a rear of a wearer's head;

wherein the first and second lateral shell portions are pivotally joined with at least one of one another, the front outer shell, and the rear outer shell;

wherein the first and second lateral shell portions pivot as the first and second lateral shell portions configure from the narrowed mode to the widened mode.

27. The method of claim 26 wherein at least a portion of the front outer shell overlaps at least a portion of the rear outer shell and at least a portion of the rear outer shell overlaps at least a portion of the front outer shell.

28. A method for adjusting lateral and longitudinal dimensions of a helmet comprising:

providing a helmet including an adjuster, a front outer shell and a rear outer shell slidably joined with the front outer shell, at least one of the front outer shell and the rear outer shell including first and second lateral shell portions at least partially separated from one another by a slot having a width;

operating the adjuster to move the first and second lateral shell portions away from one another from a narrowed mode to a widened mode to increase the lateral dimension of the helmet, and to simultaneously slide the front outer shell forward relative to the rear outer shell to increase the longitudinal dimension of the helmet as the first and second lateral shell portions move from a narrowed mode to a widened mode; and further increasing at least a portion of the longitudinal dimension of the helmet at a different time than the time during which the first and second lateral shell portions are moved from the narrowed mode to the widened mode with the adjuster, wherein a shell base is joined with the rear outer shell, and the first and second lateral shell portions move relative to the shell base in transitioning from the narrowed mode to the widened mode;

wherein the slot is covered by a slot cover as the first and second lateral shell portions move from a narrowed mode to a widened mode:, wherein the first and second lateral shell portions are pivotally joined with at least one of one another, the front outer shell, and the rear outer shell;

wherein the first and second lateral shell portions pivot as the first and second lateral shell portions configure from the narrowed mode to the widened mode.

* * * * *